US007762509B2

(12) United States Patent
Dierberger

(10) Patent No.: US 7,762,509 B2
(45) Date of Patent: Jul. 27, 2010

(54) GAS TURBINE ENGINE SYSTEMS INVOLVING ROTATABLE ANNULAR SUPPORTS

(75) Inventor: James A. Dierberger, Hebron, CT (US)

(73) Assignee: United Technologies Corp., Hartford, CT (US)

( * ) Notice: Subject to any disclaimer, the term of this patent is extended or adjusted under 35 U.S.C. 154(b) by 230 days.

(21) Appl. No.: 11/874,473

(22) Filed: Oct. 18, 2007

(65) Prior Publication Data

US 2009/0101787 A1 Apr. 23, 2009

(51) Int. Cl.
*A47F 5/00* (2006.01)

(52) U.S. Cl. ..... 248/288.31; 415/142; 415/182.1

(58) Field of Classification Search ..... 415/142, 415/182.1, 190, 138, 170.1, 200; 248/288.31, 248/637, 274.1, 288.11
See application file for complete search history.

(56) References Cited

U.S. PATENT DOCUMENTS 4,009,569 A 3/1977 Kozlin
4,334,372 A * 6/1982 Colmar ..... 40/650
4,478,551 A 10/1984 Honeycutt, Jr. et al.
5,022,816 A * 6/1991 Maier et al. ..... 415/115
5,584,511 A 12/1996 Gonzalez et al.
6,428,269 B1 8/2002 Boratgis et al.
6,442,946 B1 9/2002 Kraft et al.
6,494,032 B2 12/2002 Udall et al.
6,726,446 B2 * 4/2004 Arilla et al. ..... 415/138
6,976,655 B2 12/2005 Thompson
6,988,692 B2 1/2006 Pasquer et al.
7,097,413 B2 8/2006 VanDuyn
2006/0245676 A1 11/2006 Bruce et al.

* cited by examiner

*Primary Examiner*—Amy J Sterling

(57) ABSTRACT

Gas turbine engine systems involving rotatable annular supports are provided. In this regard, a representative support assembly for a gas turbine engine includes: a rotatable member having a first end located about a first annulus; and a stationary member located about a second annulus; the first end of the rotatable member being rotatably coupled with the stationary member, with at least a portion of the first annulus being coextensive with at least a portion of the second annulus, the first end being operative to rotate locally with respect to a corresponding portion of the stationary member.

11 Claims, 2 Drawing Sheets

GAS TURBINE ENGINE SYSTEMS INVOLVING ROTATABLE ANNULAR SUPPORTS

BACKGROUND

1. Technical Field

The disclosure generally relates to gas turbine engines.

2. Description of the Related Art

Gas turbine engines commonly incorporate ring-strut-ring assemblies for adding structural support to the engines. In hot sections of an engine, durability of ring-strut-ring assemblies may be limited due to thermal fatigue. By way of example, thermal fatigue can be caused at thermal mismatch locations where relatively hotter struts of the assembly join with the relatively cooler rings. Such a thermal mismatch can be aggravated during engine transients as the struts tend to respond faster to temperature changes than do the rings.

SUMMARY

Gas turbine engine systems involving rotatable annular supports are provided. In this regard, an exemplary embodiment of a support assembly for a gas turbine engine comprises: a rotatable member having a first end located about a first annulus; and a stationary member located about a second annulus; the first end of the rotatable member being rotatably coupled with the stationary member, with at least a portion of the first annulus being coextensive with at least a portion of the second annulus, the first end being operative to rotate locally with respect to a corresponding portion of the stationary member.

An exemplary embodiment of a gas turbine engine comprises: an engine casing; and a support assembly located within the engine casing and having a rotatable member and a stationary member; the rotatable member having at least a portion thereof located about a first annulus; the stationary member having at least a portion thereof located about a second annulus; the rotatable member being rotatably coupled with the stationary member, with at least a portion of the first annulus being coextensive with at least a portion of the second annulus, the rotatable member being operative to rotate locally with respect to a corresponding portion of the stationary member.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving rotatable annular supports are provided, several exemplary embodiments of which will be described in detail. In this regard, some embodiments accommodate loading caused by thermal mismatches associated with the mounting of various assemblies, such as ring-strut-ring assemblies. Specifically, some embodiments provide a degree of rotational freedom between support members, one of which can be attached to a ring-strut-ring assembly and the other of which can be attached to an engine casing, for example.

Figure 1:
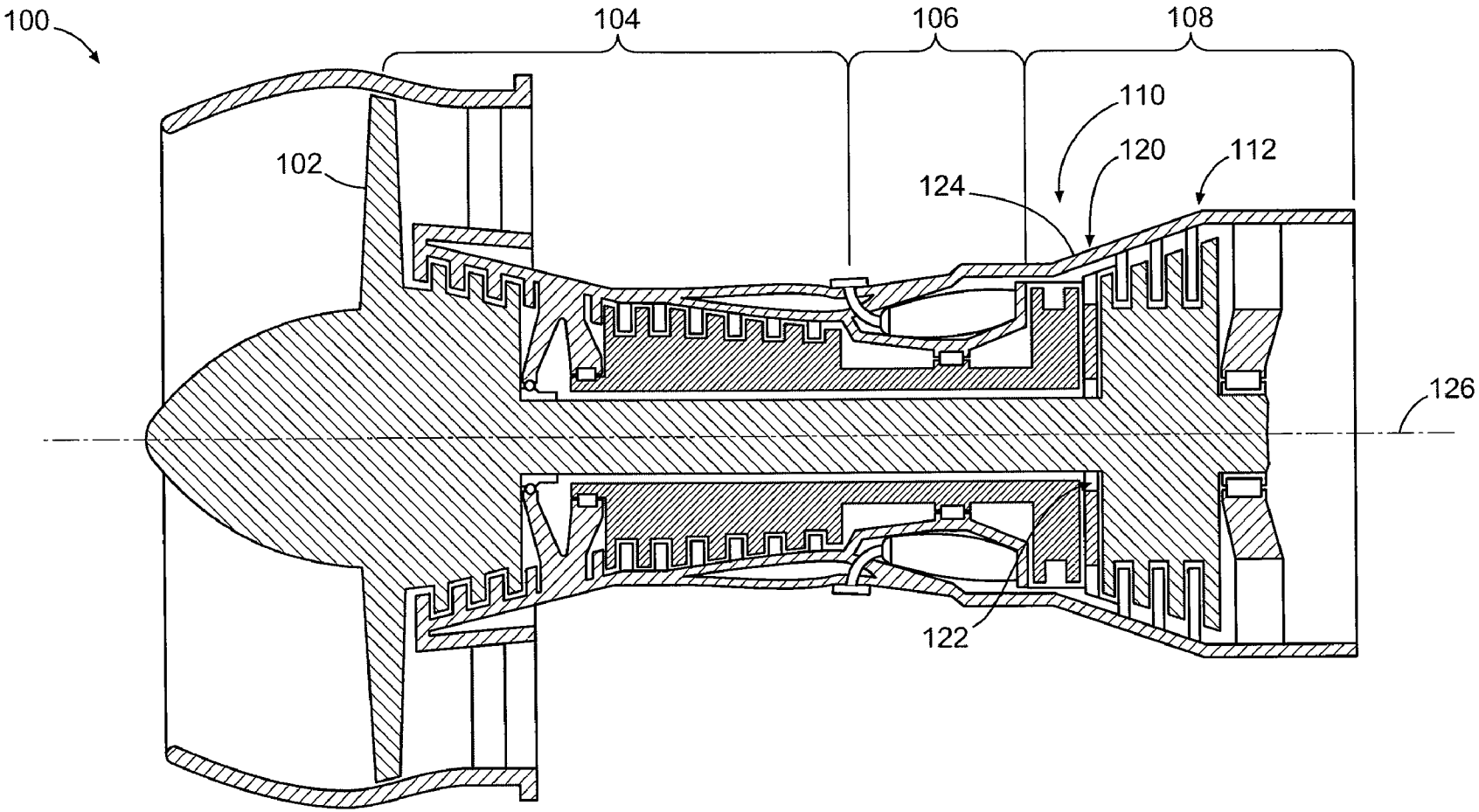
FIG. 1 is a schematic diagram depicting an exemplary embodiment of a gas turbine engine.

FIG. 1 is a schematic diagram depicting an exemplary embodiment of a gas turbine engine. As shown in FIG. 1, engine 100 incorporates a fan 102, a compressor section 104, a combustion section 106 and a turbine section 108. Specifically, turbine section 108 includes a high-pressure turbine 110 and a low-pressure turbine 112. Additionally, a support assembly 120 is positioned between high-pressure turbine 110 and low-pressure turbine 112 that generally spans between a bearing 122 and engine casing 124. Notably, the support assembly exhibits axial symmetry about a longitudinal axis 126 of the engine. Although depicted in FIG. 1 as a turbofan gas turbine engine, there is no intention to limit the concepts described herein to use with turbofans as other types of gas turbine engines can be used.

Figure 2:
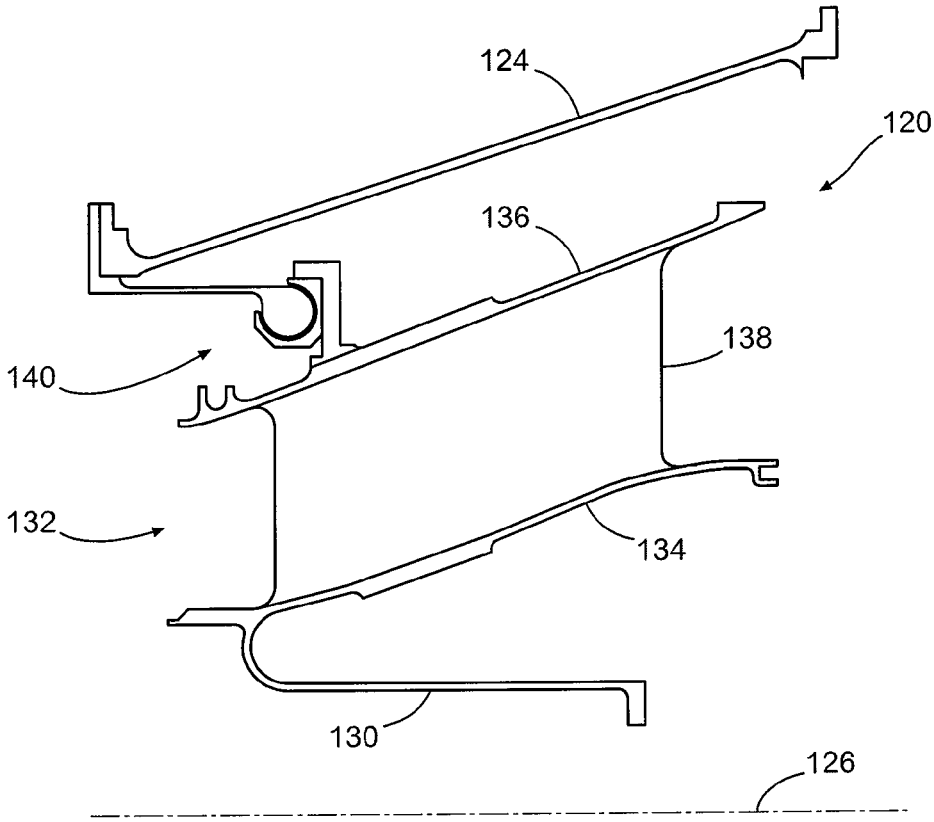
FIG. 2 is a schematic diagram depicting a portion of the engine of FIG. 1.

As shown in FIG. 2, support assembly 120 includes a bearing support 130 that spans between a bearing (i.e., bearing 122 of FIG. 1) and a ring-strut-ring assembly 132. In the embodiment of FIG. 2, the ring-strut-ring assembly includes an inner diameter platform (or ring) 134, an outer diameter platform (or ring) 136, and multiple struts (e.g., strut 138) extending between the platforms. Although strut 138 is depicted as a hollow strut, various other configurations of struts can be used in other embodiments.

Bearing support 130 is attached to the inner diameter platform 134 of the ring-strut-ring assembly. The outer diameter platform 136 is attached to engine casing 124 via a rotatable annular support assembly 140.

Figure 3:
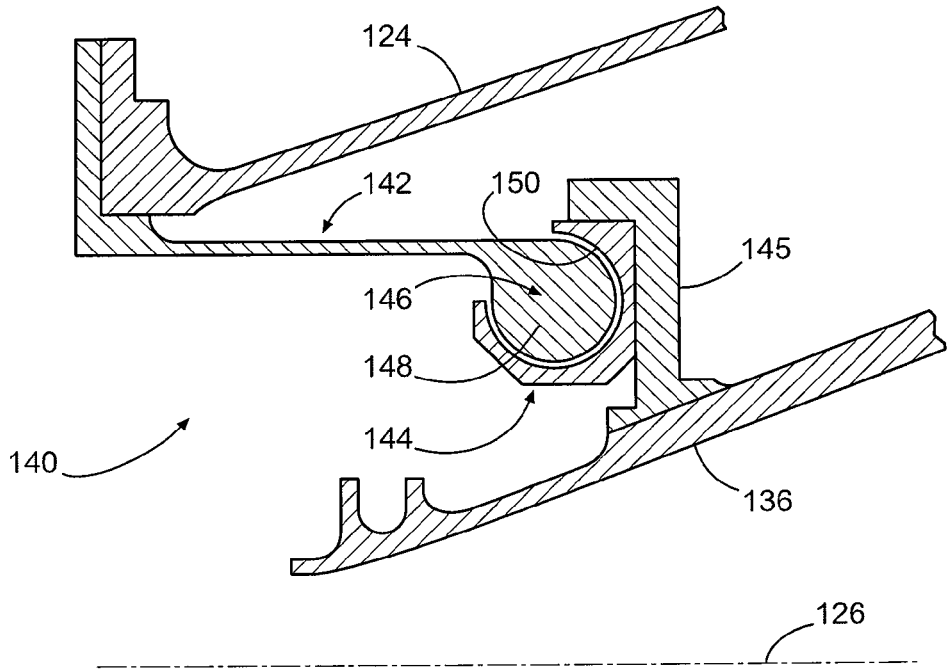
FIG. 3 is a schematic diagram depicting a portion of the embodiment of the mounting assembly of FIGS. 1 and 2.

As shown in greater detail in FIG. 3, rotatable support assembly 140 includes an rotating member 142 and a stationary member 144. Stationary member 144 is attached to the outer diameter platform 136 by an annular flange 145 that extends radially outwardly from the platform. The stationary member incorporates a cavity 146 that is located about an annulus and which is sized and shaped to receive a distal end 148 of the rotating member. In the embodiment shown, cavity 146 is a continuous cavity, thus cavity 146 is annular in shape in contrast to being formed of multiple arcuate segments annularly arranged about the longitudinal axis of the engine.

Distal end 148 of the rotating member also is located about an annulus. In the embodiment of FIG. 3, the distal end 148 is continuous. Thus, distal end 148 is annular in shape in contrast to being formed of multiple arcuate segments annularly arranged about the longitudinal axis of the engine.

As shown in FIG. 3, distal end 148 is rounded such that a longitudinal cross section of the distal end of the rotating member positioned within cavity 146 resembles a ball-and-socket joint. Notably, the cavity wall 150 of the stationary member defining cavity 146 is complementary in shape to that of the distal end of the rotating member. This configuration permits localized rotation of the rotating member with respect to the stationary member. As such, stresses (e.g., thermal mismatch between the outer diameter platform and the engine casing) imparted upon the rotatable support assembly can be accommodated.

Although the embodiment of FIG. 3 depicts the "ball portion" being carried by the rotating member and the "socket portion" being carried by the stationary member, other embodiments can transpose these features. That is, in some embodiments, the "ball portion" can be carried by the stationary member and the "socket portion" can be carried by the rotating member.

In general, embodiments of a rotatable support assembly can be positioned in one or more of various locations (either independently or in combination with other such assemblies) in order to accommodate thermally induced strain by replacing at least a portion of that strain with thermally induced rotation. As such, a rotatable support assembly can be used in numerous positions and configurations in addition to those shown and/or described herein. By way of example, some embodiments can involve positioning of the ball and socket portions adjacent to the engine casing, while others can involve the portions being positioned adjacent to an inner diameter platform (depicted in FIG. 3). In still other embodiments, a first set of ball and socket portions can be positioned adjacent to an outer diameter platform while a second set of ball and socket portions is positioned adjacent to a casing; thus, each end of such an assembly incorporates ball and socket portions.

In contrast to the fully annular distal end 148 of rotating member 142 and the fully annular cavity 146 of the stationary member 144, other embodiments can provide at least one of these features as annular arrangements of segments.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A support assembly for a bearing for a gas turbine engine employed in said support assembly comprising:

a rotatable member having a distal end located about a first annulus; and a stationary member located about a second annulus;

the first end of the rotatable member being rotatably coupled with the stationary member, with at least a portion of the first annulus being coextensive with at least a portion of the second annulus, the first end being operative to rotate locally with respect to a corresponding portion of the stationary member, said support assembly, further comprising a ring-strut-ring assembly having an inner diameter ring, an outer diameter ring and at least one strut extending between the rings, the ring-strut-ring assembly being attached to one of the rotatable member and the stationary member, said bearing being supported from said ring strut ring assembly.

2. The support assembly of claim 1, wherein the outer diameter ring of the ring-strut-ring assembly is attached to one of the rotatable member and the stationary member.

3. The support assembly of claim 1, wherein the outer diameter ring of the ring-strut-ring assembly is attached to the stationary member.

4. The support assembly of claim 1, further comprising a bearing support extending from the inner diameter ring.

5. The support assembly of claim 1, wherein:

the support assembly further comprises a bearing; and the bearing support assembly spans between the bearing and the inner diameter ring.

6. The support assembly of claim 1, wherein said at least one strut is a hollow strut.

7. The support assembly of claim 1, wherein:

the first end is rounded;

the stationary member has a cavity located along the second annulus; and the rounded first end is operative to be received within the cavity.

8. The support assembly of claim 1, wherein the first end is a continuous first end.

9. The support assembly of claim 1, wherein the cavity is a continuous cavity.

10. The support assembly of claim 1, wherein:

one of the stationary member and the rotatable member has a cavity; and another of the stationary member and the rotatable member has portion operative to be retained by and rotatable within the cavity.

11. The support assembly of claim 10, wherein the cavity is an annular cavity.

* * * * *